US006478158B2

(12) United States Patent
Gaffney et al.

(10) Patent No.: US 6,478,158 B2
(45) **Date of Patent: *Nov. 12, 2002**

(54) BATTERY PACKAGE WITH MULTIPLE SUPPORT COMPARTMENTS

(75) Inventors: Robert C. Gaffney, Sun Prairie, WI (US); Gerald A. Albright, Middleton, WI (US); Ron G. Hellenbrand, Middleton, WI (US); Ross Mack, Dane, WI (US)

(73) Assignee: Rayovac Corporation, Madison, WI (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/440,605

(22) Filed: Nov. 15, 1999

(65) Prior Publication Data

US 2001/0052479 A1 Dec. 20, 2001

Related U.S. Application Data

(63) Continuation-in-part of application No. 09/344,130, filed on Jun. 24, 1999, which is a continuation-in-part of application No. 29/100,237, filed on Feb. 8, 1999, now Pat. No. Des. 419,441, and a continuation-in-part of application No. 29/094,324, filed on Sep. 30, 1998, now Pat. No. Des. 413,803.

(51) Int. Cl.[7] ..... B65D 85/00

(52) U.S. Cl. ..... 206/705; 206/704

(58) Field of Search ..... 206/703, 705, 206/701, 723, 725, 704; 220/507

(56) References Cited

U.S. PATENT DOCUMENTS 1,121,232 A 12/1914 Davis (List continued on next page.)

FOREIGN PATENT DOCUMENTS

| | | |
|---|---|---|
| DE | 2158595 | 5/1972 |
| FR | 76 14126 | 1/1977 |

OTHER PUBLICATIONS

Exhibit One —MTM Case–Gard J–20 series rifle cartridge case; mtmmolded.com, MTM Molded Products Co., Dayton, OH 45414 (photo).

(List continued on next page.)

*Primary Examiner*—Mickey Yu
*Assistant Examiner*—Troy Arnold
(74) *Attorney, Agent, or Firm*—Quarles & Brady LLP

(57) ABSTRACT

A retail package for round cell batteries is a transparent single sheet thermoformed clamshell having a cover connected along a hinge to a base which receives an array of upwardly extending batteries. The base has a side wall which extends upwardly from a flat bottom wall. The side wall has a lower section which is substantially perpendicular to the bottom wall and has a zero degree draft angle. Semicylindrical pockets are defined by the base wall lower portion and batteries are positioned in the pockets two abreast. Thus, each battery is engaged by a portion of the side wall and another battery. Hence, a partially emptied container will still retain most of the batteries upright. The cover has a downwardly extending skirt with an inwardly extending semicircular closure tab which engages beneath a lip formed on the base side wall. The lid closure may be released by pressing the base side wall. More than two rows of batteries may be accommodated within a package by providing the lower side wall with an intermediate segment which extends upwardly from the bottom wall within the container to divide the container into a plurality of compartments, each compartment having portions defining an array of battery pockets, each array being exactly two pockets wide, and at least two pockets long.

17 Claims, 3 Drawing Sheets

U.S. PATENT DOCUMENTS

| | | | | |
|---|---|---|---|---|
| 2,465,644 | A | | 3/1949 | Graves |
| 3,082,903 | A | | 3/1963 | Stevens et al. |
| D231,433 | S | | 4/1974 | Congleton |
| 4,209,091 | A | | 6/1980 | Lieberman |
| 4,235,338 | A | | 11/1980 | Dugan et al. |
| 4,401,229 | A | | 8/1983 | Bell et al. |
| D285,413 | S | | 9/1986 | Carlson |
| 4,645,079 | A | | 2/1987 | Hill |
| 4,958,731 | A | | 9/1990 | Calcerano |
| 5,012,928 | A | | 5/1991 | Proffitt et al. |
| 5,046,659 | A | | 9/1991 | Warburton |
| D326,409 | S | | 5/1992 | Krueger et al. |
| D327,220 | S | | 6/1992 | Proffitt et al. |
| 5,232,094 | A | | 8/1993 | Fagnant et al. |
| 5,370,227 | A | | 12/1994 | Shibazaki et al. |
| 5,586,657 | A | | 12/1996 | Ward et al. |
| 5,735,404 | A | | 4/1998 | Kumakura et al. |
| D394,207 | S | | 5/1998 | Waterbury et al. |
| 5,839,583 | A | * | 11/1998 | Pope et al. ..... 206/704 |
| D408,732 | S | | 4/1999 | Gaffney et al. |

OTHER PUBLICATIONS

Exhibit Two—CASE–GARD 20 Rifle Cartridge Case; mtm-molded.com, MTM Molded Products Co., Dayton, OH 45414 (photo).

Exhibit Three—CASE–GARD P50 Cartridge Case; mtm-molded.com, MTM Molded Products Co., Dayton, OH 45414 (photo).

* cited by examiner

BATTERY PACKAGE WITH MULTIPLE SUPPORT COMPARTMENTS

CROSS REFERENCES TO RELATED APPLICATIONS

This application is a continuation-in-part of 09/344,130, filed Jun. 24, 1999, which was a continuation-in-part of application Ser. No. 29/100,237, filed Feb. 8, 1999, now U.S. Pat. No. D. 419,441, and a continuation-in-part of application Ser. No. 29/094,324, filed Sep. 30, 1998, now U.S. Pat. No. Des. 413,803, issued Sep. 14, 1999, the disclosures of all of said applications being hereby incorporated by reference herein.

BACKGROUND OF THE INVENTION

The present invention relates to specialized containers in general, and more particularly to packages for retail display of round cell batteries.

By universal agreement, a number of battery types have been defined in terms of voltage, current, and dimensional criteria. Most common among these defined battery types are the round cells, readily available sources of direct current packaged in cylindrical canisters. These round cells have been given letter designations and range, in physical size, from AAAA, AAA, AA, C to D.

Although the battery chemistries, available power, and recharging options may vary, the dimensions and electrical properties are confined within agreed-upon tolerances. These standardized battery properties allow consumers to replenish the battery compartments of their electronic devices from the stocks of thousands of convenience stores, hardware stores, and electronic shops throughout the world.

Advancements in microcircuitry, optics, and micromachinery, have resulted in a proliferation of portable electronic devices which rely on standard round cells for power. Whereas a hundred years ago a consumer might possess only one or two lanterns or flashlights calling for batteries, the modern household, in addition to flashlights, may have portable radios, CD and tape players, intercoms, cellular phones, computers, musical devices, camcorders, interactive toys, remote control cars, calculators, or any of a multitude of home electronic devices.

To anticipate the immediate need for replacement batteries, the modern consumer is called on to maintain a stockpile of batteries of various sizes ready at hand. To address this need, manufacturers package multiple batteries in a single container, usually offering a reduced unit price for quantity purchases. Multiple batteries have been offered on blister cards, such as those shown in U.S. Pat. No. Des. 408,732; in front-to-back plastic clamshell packages, and in paperboard containers, such as those shown in U.S. Pat. No. 5,823,350.

Although a consumer may desire to purchase multiple batteries in a single package, often a single replenishment of an electrical device will not fully deplete the multi-battery package. In these cases, the unused batteries will be unconstrained unless the battery package itself serves as a container after the package has been opened. The problem presented by unconstrained batteries is particularly acute with round cells, which will tend to roll along any flat surface.

What is needed is a multi-battery package which presents batteries for attractive retail display while at the same time restraining a subset of the batteries within the package to serve as a container after it has been opened.

SUMMARY OF THE INVENTION

A retail package for round cell batteries is a transparent single sheet thermoformed clam shell having a cover connected along a perforated hinge to a base which receives an array of upwardly extending batteries. The base has a side wall which extends upwardly from a flat bottom wall. The side wall has a lower section which is substantially perpendicular to the bottom wall and has a zero degree draft angle. Semicylindrical pockets are defined by the base wall lower portion and batteries are positioned in the pockets two abreast. Thus, each battery is engaged by a portion of the side wall and another battery. Hence, a partially emptied container will still retain most of the batteries upright. A package for a larger number of batteries, for example two dozen AA batteries, may be formed by providing the lower side wall with an intermediate segment which extends upwardly from the bottom wall within the container to divide the container into a plurality of compartments, each compartment having portions defining an array of battery pockets, each array being exactly two pockets wide, and at least two pockets long.

It is an object of the present invention to provide a retail display package for multiple batteries which prominently displays the package contents.

It is also an object of the present invention to provide a container for multiple batteries which retains batteries in an upright position after removal of a subset of the batteries.

It is an additional object of the present invention to provide a battery container which is readily loaded by automatic machinery.

It is another object of the present invention to provide a package for multiple batteries with a closure which is readily opened.

Further objects, features and advantages of the invention will be apparent from the following detailed description when taken in conjunction with the accompanying drawings.

DESCRIPTION OF THE PREFERRED EMBODIMENTS

Figure 1:
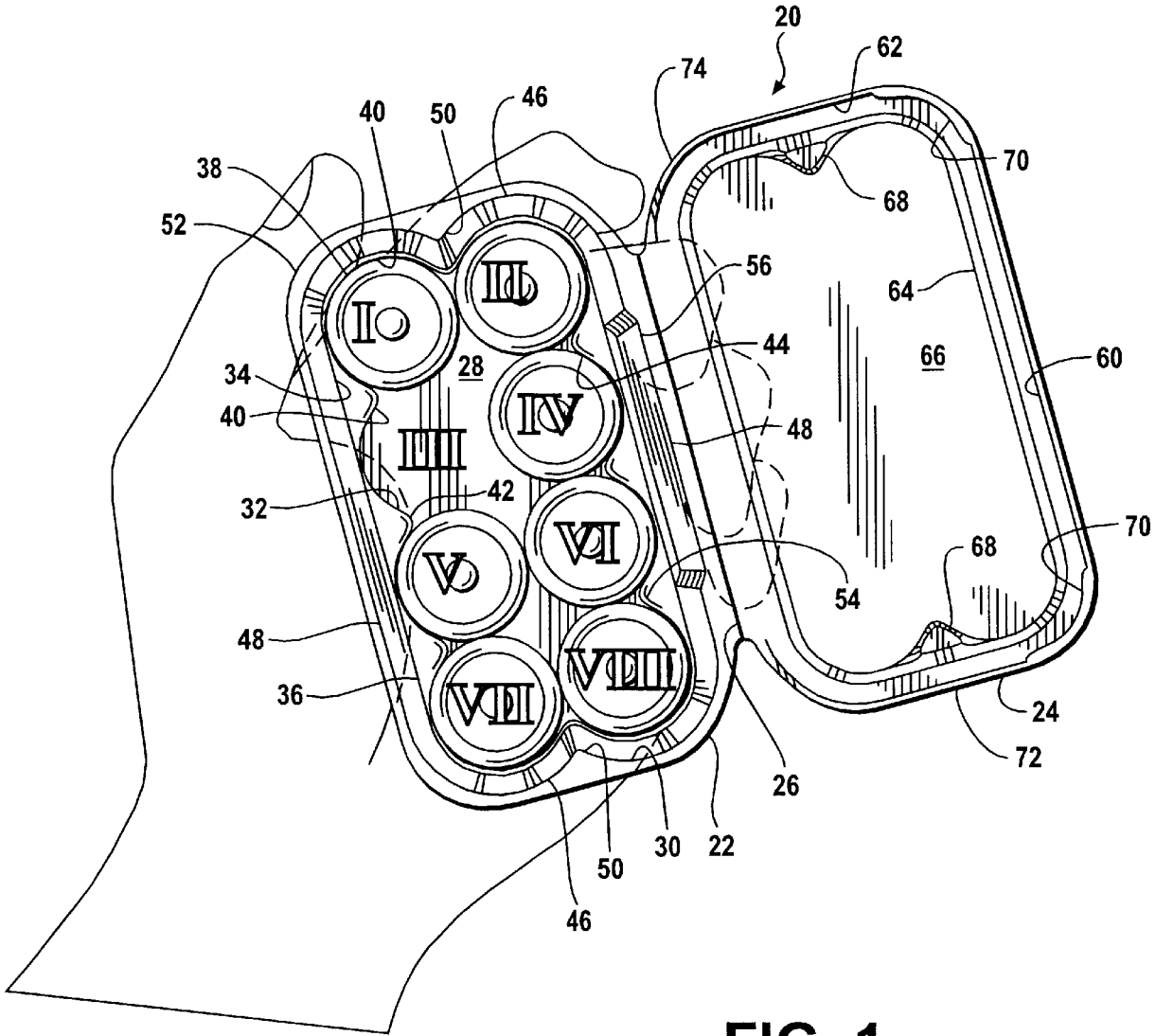
FIG. 1 is a top view of the battery package of this invention in an open configuration held tilted on its side with a single battery removed.

Referring more particularly to FIGS. 1–5, wherein like numbers refer to similar parts, a multiple battery package and container 20 is shown in FIG. 1. The container 20 is a single-sheet thermoformed thermoplastic package. In the single-sheet thermoforming process, a single sheet of thermoplastic material is heated and then brought into contact with a molding tool having a plurality of ports through which air is drawn to cause the semi-molten plastic to conform to the shape of the molding tool. The container 20 may be formed of PVC plastic, or alternatively of polyethylene, polyurethane, polypropylene, PET, RPET, or other suitable thermoplastic materials. The sheet is a thin sheet of thermoplastic, for example about 0.02 inches thick.

The container 20 is a clamshell package having a base 22 with a cover 24 connected to the base along a perforated plastic hinge 26. The base 22 has a generally flat bottom wall 28 with an upwardly extending encircling side wall 30. The encircling side wall 30 has a lower side wall 32 which extends nearly perpendicular to the bottom wall 28 and an upper side wall 34 which extends from the lower side wall at a generally horizontal transition wall 36. The lower side wall 32 is formed as a "zero draft" segment of the part, while the upper side wall 34 is inclined outwardly from the perpendicular at conventional draft angles, for example from 3 degrees to 7 degrees, and preferably about 5 degrees. Although the container 20 may be formed for any desired round cell, the unit illustrated in the figures is specially configured to receive eight C cell batteries. Whereas the total height of the base is approximately 4.5 centimeters, the lower side wall is approximately 1 cm tall. In general, the lower side wall may be about one fifth the height of the base.

Figure 2:
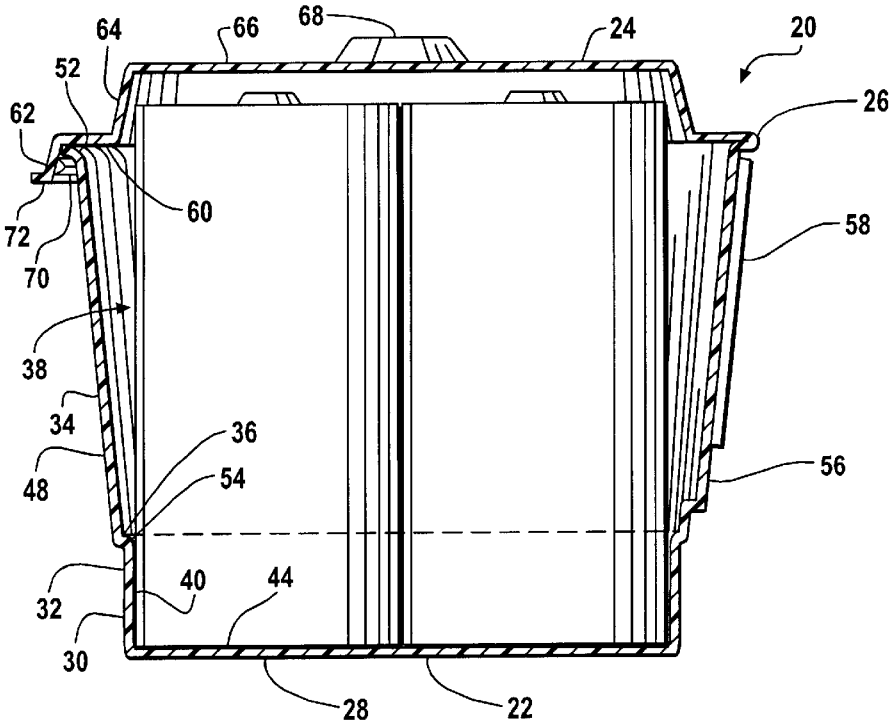
FIG. 2 is a cross-sectional view of the battery package of FIG. 1, in a closed configuration, taken along section line 2—2, with the thickness of the package walls exaggerated for clarity.

As shown in FIG. 2, the lower side wall 32 engages the cylindrical exterior of a battery 38, while the upper side wall 34 diverges away from the battery 38. As shown in FIG. 1, the lower side wall is composed of a sequence of semicylindrical segments 40, each segment being separated from the next by an inward protrusion 42. Together, the semicylindrical segments 40 and inward protrusion 42 define an array of battery pockets 44 rising up from the bottom wall 28. A separate pocket 44 will correspond to each battery 38 received within the container 20. The array of pockets 44 will be no more than two batteries deep in one dimension, and at least two batteries wide in the other dimension. The number of batteries in the long dimension of the array will vary depending on the desired size of the package, but will generally be in the range of four to six. For purposes of discussion herein, each battery position defined by the eight pockets 44 has been designated in FIG. 1 with a Roman numeral.

Figure 3:
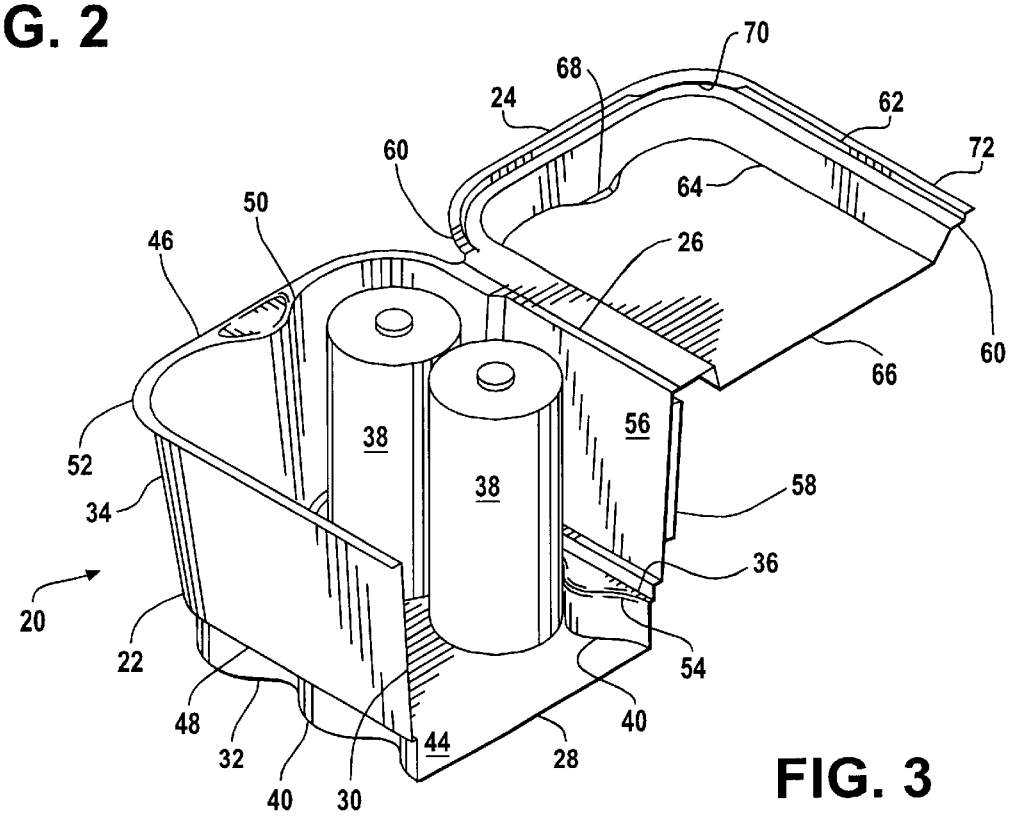
FIG. 3 is a fragmentary isometric view of the package of FIG. 1.

The semicylindrical segments 40 located at the opposite ends 46 of the base side wall 30 wrap approximately 180 degrees of the circumference of the batteries 38 in the pockets I, II, VII, and VIII. The semicylindrical segments 40 on the long portions 48 of the side wall 30 each wrap approximately ninety degrees of the batteries positioned within pockets III, IV, V, and VI. As shown in FIG. 3, the inward protrusions 42 which separate the semicylindrical segments 40 are confined to the lower side wall 32. However, similar full height protrusions 50 are provided on the ends 46 of the side wall 30 which extend the full height of the upper side wall 34 and which terminate at an outwardly extending peripheral lip 52 which encircles the upper edge of the upper side wall.

As shown in FIG. 2, the transition wall 36 provides a radiused inlet 54 to each pocket 44. The radiused inlets 54 assist the loading of the container 20, as discussed below.

The upper side wall 34 may be provided with an outwardly protruding security tag bubble 56 which extends away from the contained batteries 38. As disclosed in U.S. Pat. Nos. 5,586,657 and 5,871,100, the disclosures of which are incorporated by reference herein, a battery container can be configured to operate with a security tag sensing detector by spacing a security tag 58 on the container 20 a determined distance away from the batteries. As shown in FIG. 2,the security tag 58 is positioned on the bubble 56 which, like the upper side wall from which protrudes, is inclined outwardly, thus obtaining maximum spacing of the security tag 58 from the batteries.

The hinge 26 is defined by a score line or fold line extending along the base peripheral lip 52. The cover 24 extends from the hinge 26 at a cover lip 60 which, in the cover open position extends in approximately the same plane as the hinge 26. In the cover closed position, shown in FIG. 2, the cover lip 60 overlies the base peripheral lip 52. A skirt 62 extends downwardly from the cover lip 60 to encircle the three sides of the base 22 not including the hinge 26 side. A cover side wall 64 extends upwardly from the cover lip 60 and is positioned inwardly of the cover skirt 62. A top wall 66 extends inwardly from the cover side wall 64. Two nesting protrusions 68 extend upwardly from the top wall 66. The nesting protrusions 68 are positioned and shaped to extend inwardly to engage a similar container 20 stacked on the top wall 66. The overlying container 20 may be positioned so that the inward protrusions 42 on the ends 46 of the lower side wall 32 meet with the nesting protrusions 68, thereby permitting secure stacking of multiple loaded containers 20.

As shown in FIG. 1, the cover 24 is preferably provided with two semi-circular closure tabs 70 which extend inwardly from the cover skirt 62. The closure tabs 70 are positioned at the corners of the cover spaced from the hinge 26, and are positioned to engage beneath the base peripheral lip 52 when the cover is closed on the base as shown in FIG. 2. As shown in FIG. 3, the closure tabs 70 extend inwardly from a cover flange 72 which extends outwardly from the cover skirt 62. The cover flange 72 is spaced from the hinge 26 on three sides of the cover, but connects to the cover lip 60 by ramped sections 74 adjacent the hinge side of the base 22. This arrangement allows the cover to be pivoted about a hinge axis which lies in the same plane as the cover lip 60 and the base lip 52.

Multiple battery packages serve several functions. First, they contain and display batteries in a retail environment. The container 20 performs advantageously as a retail display package, especially when it is formed of substantially transparent plastic sheet material. The flat bottom wall, top wall, and long segments of the side wall provide minimal optical impediments to customer perception of the product contained within. The graphics on the contained round cells themselves provide the predominant graphic message of the container. The package is readily sealed by an adhesive label, not shown, which extends over the cover and onto the base side wall. In addition, the protrusions 68 of the cover permit multiple similar battery containers to be stacked one upon the other.

Although an attractive package is helpful at the point-of-sale in drawing the customer's attention to the product, once purchased the customer has more utilitarian demands. Although a stockpile of multiple batteries readily available within the home or workplace is desired by the purchaser of a multiple battery product, frequently batteries will be drawn from this stockpile in quantities less than the total number contained within the package. The lower side wall 32 of the container 20, by providing discrete pockets 44 for each battery, contributes to the convenient and organized storage of less than the full complement of batteries.

As shown in FIG. 1, each battery 38 is engaged by the bottom wall 28, the lower side wall 32, and at least one other battery. When the container 20 is fully loaded with its complete complement of batteries 38, each battery is restrained on four sides in addition to the bottom wall. The batteries 38 in positions I, II, VII, and VIII are engaged by the lower side wall end portions 46 and the long portions 48, as well as two other batteries. The batteries 38 in positions III, IV, V, and VI are engaged by long portions 48 of the lower side wall 32 and three other batteries. However, as batteries are extracted from the container 20, support for the remaining batteries is decreased. Nevertheless, the configuration of the inward protrusions 42 defining the pockets 44 allows the container 20 to provide significant support for any pair of batteries positioned between the long portions 48 of the lower side wall 32 and adjacent one another.

As shown in FIG. 2, the two batteries positioned between the long portions 48 of the lower side wall 32 are engaged against each other and against the zero draft perpendicular semicylindrical segments 40 of the lower side wall 32. This engagement restricts the tipping of the batteries towards one or the other of the ends 46 of the container 20. As shown in FIG. 1, the removal of an adjacent battery, for example of the battery in position III, while removing some support for the batteries in positions I, IV, and V, will not leave the batteries in positions I and V unsupported. The two protrusions 42 which engage the pair of batteries in positions I and II prevent those batteries from sliding within the package. Furthermore, the lower side wall 32 extends upwardly sufficiently to restrict the tilting of the batteries in those positions. In the partially depleted package of FIG. 1, the battery in position IV will not be restricted from sliding between the long portions 48 of the side wall, although the remaining batteries will restrain it within the space defined by positions III and IV. Thus, although when an odd number of batteries are present within the container, at least one battery will be loose, in most cases, the majority of the remaining batteries will be retained in an upright condition within the container 20 ready for access.

As shown in FIG. 3, the container, while snugly engaging the loaded batteries, also provides easy access to each battery due to the diverging upper side walls 34. The result of the outward inclination of the upper side walls 34 is that a clear margin unoccupied by battery or plastic material is defined around the tops of the batteries, thereby allowing the user to grasp a battery with two fingers and extract it by pulling upwardly.

The thin plastic of the container 20 is somewhat resilient, with the result that the package tends to return to its original shape after it is temporarily twisted or distorted. In addition, the perforated hinge 26 functions like a spring, tending to restore the cover to its original, molded, open, configuration. Thus the closure tabs 70 are preferably configured to engage with the base peripheral lip 52 in such a way that the upper side wall may be depressed inwardly to engage the batteries and to be removed from engagement with the closure tabs, causing the cover to spring open. In some sizes of packages it may thus be possible to open the container with one hand.

The container 20 is also amenable to effective and economical filling with batteries. The diverging upper side wall directs the loaded batteries downwardly into engagement with the radiused inlets 54 at the transition to the lower side wall for smooth entry into the pockets 44. Because the bottom wall 28 of the container 20 is flat and featureless between the lower side wall, it presents minimal impediments to accurate loading of a full complement of batteries. Typically, batteries will not be loaded sequentially, but will be loaded together.

Figure 4:
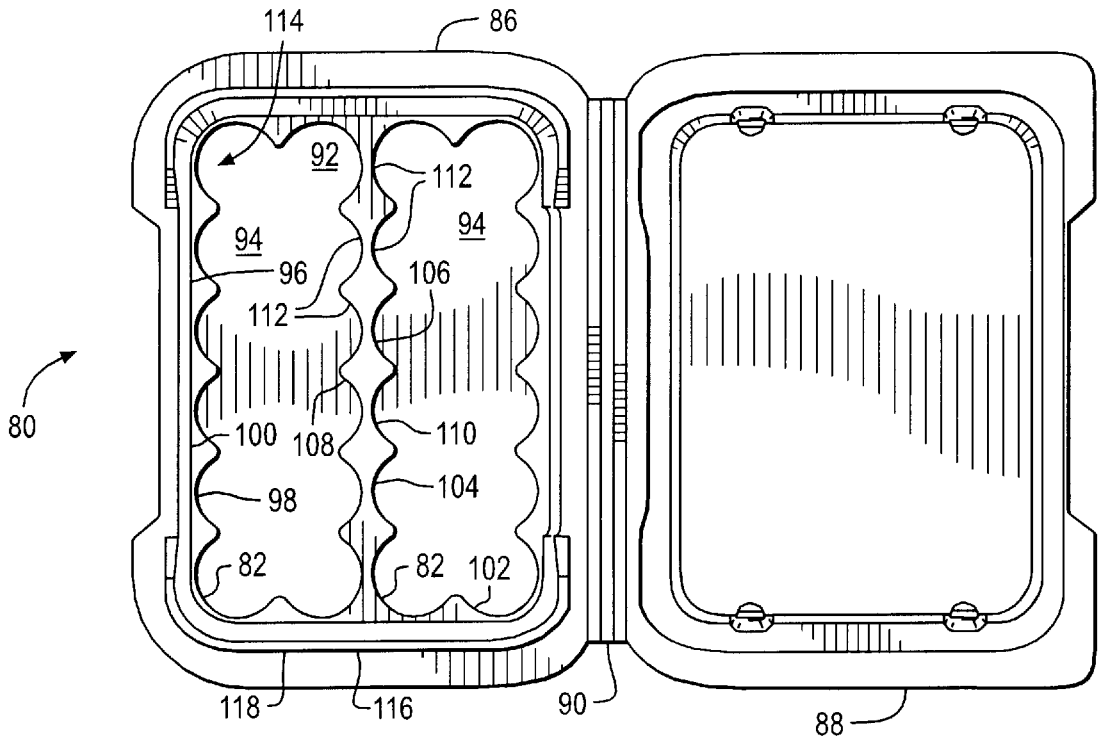
FIG. 4 is a top plan view of an alternative embodiment battery package of this invention having a plurality of compartments for arrays of batteries two abreast.
Figure 5:
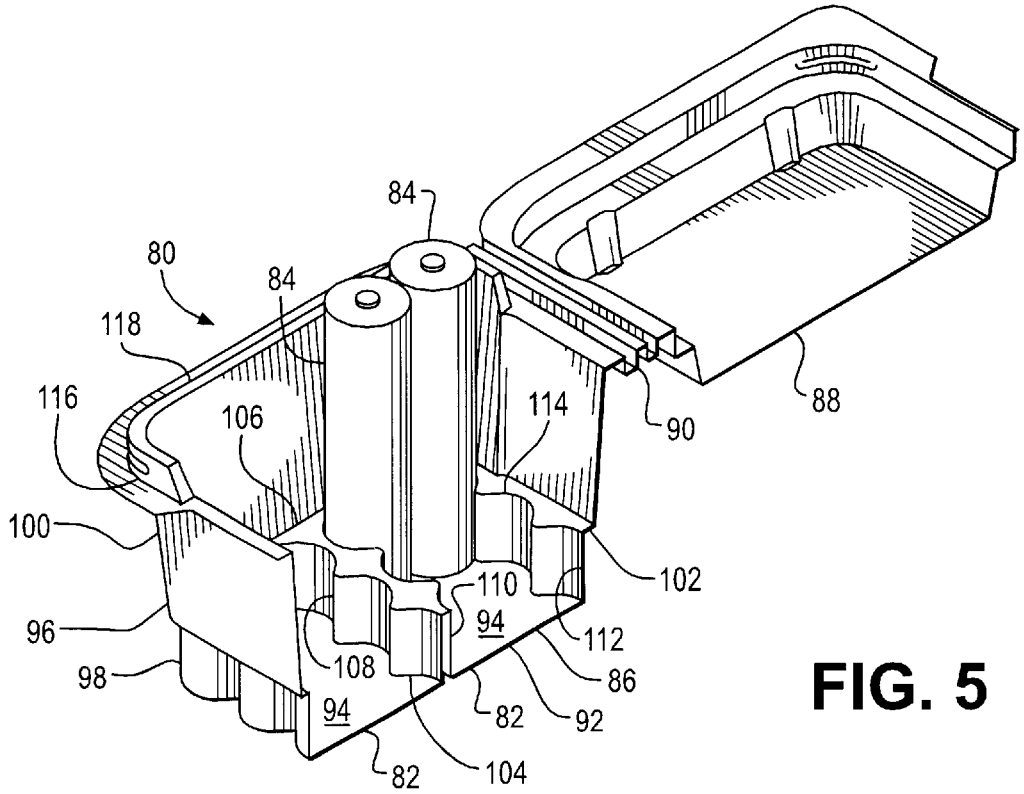
FIG. 5 is a cut-away isometric view of the package of FIG. 4 taken along section line 5—5, shown with two batteries positioned therein.

An alternative embodiment battery package 80 is shown in FIGS. 4 and 5. The package 80 may be configured for any round cell size, but it is illustrated for AA batteries. When it is desired to contain a larger number of batteries without having a package which is unduly long for its width, the package may be provided with two compartments 82 for multiple arrays of batteries 84. The battery package 80 has a base 86 with a cover 88 pivotally connected to the base along a hinge 90. The bottom wall 92 is comprised of two bottom segments 94, one bottom segment forming the base of each of the two compartments 82. The base 86 has an upwardly extending side wall 96 which extends from and encircles the bottom wall 92. The side wall 96 is comprised of a lower side wall 98 which extends immediately adjacent and perpendicular to the bottom wall 92, and an upper side wall 100 which extends upwardly from a generally horizontal narrow transition segment 102 which extends adjacent the lower side wall. The upper side wall has a draft angle and is sloped away from the batteries 84.

The lower side wall 98 has an intermediate segment 104 which extends between the two compartments 82. The intermediate segment 104 has an upper surface generally coplanar with the transition segment 102 which defines a spacing platform 106 between the two compartments 82. The intermediate segment 104 has a first support portion 108 which extends upwardly perpendicular to the bottom wall 92 adjacent a first compartment 82, and a second support portion 110 separated from the first support portion by the spacing platform 106. The second support portion 110 extends upwardly perpendicular to the bottom wall adjacent to a second compartment 82. Both the first support portion 108 and the second support portion 110 are comprised of a sequence of concave semicylindrical segments 112. The semicylindrical segments 112 are of a radius approximately that of the batteries 84. Each compartment 82 thus defines an array of battery pockets 114 which is exactly two pockets wide and at least two pockets long. The battery pockets 114 are similar to those described above with respect to the package 20, although the proportions of the pockets will vary depending on the type and number of batteries accommodated. Batteries 84 are received two abreast within the pockets to be engaged with one another and between two opposed portions of the lower side wall 98—one portion on the intermediate segment 104 of the lower side wall, and one portion on the lower side wall on the exterior of the container 80.

To provide added rigidity to the side wall 96, a skirt 116 may be formed which extends downwardly from a partial peripheral lip 118 which extends outwardly from the upper side wall 100. As shown in FIG. 4, skirt/peripheral lip structures may be provided on opposite ends of the container 80. The cover 88 engages over the peripheral lip 118 to secure the cover to the base 86 in a closed configuration. The container 80 may be provided with closure tabs similar to those on the container 20.

The structure of the lower portion of each compartment 82 is similar to the lower side wall portions of the container 20. Thus, within each compartment 82 the batteries two abreast engage each other and opposite portions of the lower side wall 98 to retain the batteries upright. The container 82 may also be provided with projections on the cover to permit multiple containers to be stacked one upon another and restricted against shifting.

It should be noted that, although a perforated hinge has been shown, other conventional hinge structures may be employed, including molded hinges of various sizes. Furthermore, although a C cell battery package has been disclosed, the invention may also be dimensioned to accommodate AAAA, AAA, AA, D, or other round cells.

It is understood that the invention is not limited to the particular construction and arrangement of parts herein illustrated and described, but embraces such modified forms thereof as come within the scope of the following claims.

We claim:

1. A container for multiple generally cylindrical batteries, the container comprising:

a base having a bottom wall comprising a first generally flat bottom segment and a second generally flat bottom segment, wherein a side wall extends upwardly from the bottom wall, the side wall having a lower side wall which extends approximately perpendicular to the bottom wall, and an upper side wall which extends above the lower side wall which slopes outwardly from the lower side wall, wherein portions of the lower side wall define a plurality of semicylindrical segments adjacent each bottom segment, and wherein an intermediate segment extends upwardly between and separates the first bottom segment and the second bottom segment, the intermediate segment having a first support portion which defines a plurality of semicylindrical segments which open into an unobstructed central portion of the first bottom segment which receives more than one cylindrical battery, and a second support portion which defines a plurality of semicylindrical segments, a first array battery pockets being defined upwardly of the first bottom segment, and a second array of battery pockets being defined upwardly of the second bottom segment, each array being exactly two pockets wide and at least two pockets long, the pockets being defined by the semicylindrical segments such that when the batteries are contained in the container, they are received two abreast within the base, and at least one pair of said batteries touch one another between two opposed semicylindrical segments; and a cover positioned to selectably cover and permit access to the batteries positioned within the side wall.

2. The container of claim 1 wherein the container is thermoformed from a single sheet of substantially transparent thermoplastic material.

3. The container of claim 1 further comprising a transition segment extending between the base lower side wall and the base upper side wall, wherein the transition segment is radiused to assist the entry of batteries into the pockets.

4. The container of claim 1 wherein a spacing platform is defined on the intermediate segment which extends between the first support portion and the second support portion, and is spaced above the first bottom segment and the second bottom segment.

5. A container for multiple generally cylindrical batteries, the container comprising:

a bottom wall;

a side wall which extends upwardly from the bottom wall, the side wall having a lower side wall which extends approximately perpendicular to the bottom wall, and an upper side wall extending above portions of the lower side wall, wherein the upper side wall slopes outwardly from the lower side wall;

portions of the lower side wall which extend inwardly to, define an array of battery pockets which open into an unobstructed central portion of the array which receives more than one cylindrical battery, the array being exactly two pockets wide and at least two pockets long the pockets being defined by the inwardly extending portions such that when batteries are contained in the container, they are received abreast within the pockets, and at least one pair of said batteries touch one another between two opposed portions of the lower side wall; and a cover positioned to selectably cover and permit access to the batteries positioned within the side wall, wherein in a covering position, the cover is engaged with portions of the side wall to be retained thereon.

6. The container of claim 5 wherein the lower side wall has an intermediate segment which extends upwardly from the bottom wall within the container to divide the container into a plurality of compartments, each compartment having portions defining an array of battery pockets, each array being exactly two pockets wide, and at least two pockets long.

7. The container of claim 6 wherein the intermediate segment of the lower side wall has a first support portion which extends approximately perpendicular to the bottom wall within a first compartment, and a second support portion which extends approximately perpendicular to the bottom wall within a second compartment, and a spacing platform which extends between the first support portion and the second support portion.

8. The container of claim 5 wherein the container is thermoformed from a single sheet of substantially transparent thermoplastic material.

9. The container of claim 5 further comprising a transition segment extending between the lower side wall and the upper side wall, wherein the transition segment is radiused to assist the entry of batteries into the pockets.

10. The container of claim 5 further comprising:

portions of the upper side wall which define an outwardly protruding security tag bubble; and a security tag positioned on the bubble to make the container detectable by a security tag sensing detector.

11. The container of claim 5 further comprising at least one closure tab which extends inwardly from the cover to engage portions of the base and to retain the cover closed on the base, wherein inward flexing of the base upper side wall causes the closure tab to release the cover from engagement with the base.

12. The container of claim 5 wherein the side wall has two opposite ends, with long portions extending between the two opposite ends, and wherein each of the two opposite ends has an inwardly extending protrusion.

13. The container of claim 5 wherein the cover has a plurality of upwardly extending nesting protrusions, the nesting protrusions being of a shape to be received within the portions of the lower side wall which extend inwardly to define the battery pockets of a like container positioned above, such that multiple containers are stackable one upon the other.

14. A package containing a plurality of generally cylindrical batteries, comprising:

a bottom wall;

a plurality of batteries disposed on the bottom wall;

a side wall which extends upwardly from the bottom wall;

portions of the side wall which define a plurality of protrusions which extend inwardly and which extend upwardly from the bottom wall substantially perpendicular thereto, wherein a first battery is engaged in a segment defined between two protrusions, and a second battery is engaged in a segment defined between two protrusions which are spaced opposite the first battery, each of said segments opening into an unobstructed central portion which receives more than one cylindrical battery and is common to said segments and wherein the first battery touches the second battery to be retained in an upright configuration extending generally perpendicular to the bottom wall;

an intermediate segment extending from the side wall and perpendicular to the bottom wall and spaced from the second battery, and further having a segment which engages a third battery which is not touching the first battery or the second battery; and portions of the lower side wall which extend substantially perpendicular to the bottom wall which define a segment which engages a fourth battery which extends parallel to the third battery and which engages the third battery, the third battery and the fourth battery being thereby held in an upright condition with respect to the bottom wall, wherein portions of the side wall and the intermediate segment define at least two compartments, each having a generally flat bottom wall and containing therein an array of batteries two abreast; and a cover engaged with the base.

15. The assembly of claim 14 wherein between about one quarter and one half of the circumference of each battery is contacted by a portion of the lower side wall.

16. The container of claim 1 further comprising a generally horizontal transition segment extending between the lower side wall and the upper side wall, wherein the transition segment is radiused to assist the entry of batteries into the pockets.

17. The container of claim 5 further comprising a generally horizontal transition segment extending between the lower side wall and the upper side wall, wherein the transition segment is radiused to assist the entry of batteries into the pockets.

* * * * *

UNITED STATES PATENT AND TRADEMARK OFFICE

CERTIFICATE OF CORRECTION

PATENT NO. : 6,478,158 B2
DATED : May 23, 2003
INVENTOR(S) : Gaffney et al.

It is certified that error appears in the above-identified patent and that said Letters Patent is hereby corrected as shown below:

Column 3,
Line 67, insert space after “FIG. 2,” -- FIG. 2, the --

Column 7,
Line 26, insert “of” between “array battery” -- array of battery --
Line 60, delete comma “,” from “to,”
Line 64, insert comma -- , -- after “pockets long” -- pockets long, --

Signed and Sealed this

Second Day of September, 2003

JAMES E. ROGAN
*Director of the United States Patent and Trademark Office*